US005391085A

United States Patent [19]

Tigner

[11] Patent Number: 5,391,085

[45] Date of Patent: Feb. 21, 1995

[54] ELECTRICAL SOCKET ASSEMBLY INCLUDING SAFETY DEVICE

[76] Inventor: Alexander B. Tigner, 145 E. 27th St., Apt. 10 F, New York, N.Y. 10016

[21] Appl. No.: 82,272

[22] Filed: Jun. 24, 1993

[51] Int. Cl.[6] ..... H01R 13/453

[52] U.S. Cl. ..... 439/137; 439/145

[58] Field of Search ..... 439/137, 139, 145

[56] References Cited

U.S. PATENT DOCUMENTS

| | | | |
|---|---|---|---|
| 3,980,370 | 9/1976 | Gonzalez-Hernandez | 200/51.09 |
| 4,722,693 | 2/1988 | Rose | 439/137 |
| 4,867,694 | 9/1989 | Short | 439/137 |
| 5,020,997 | 6/1991 | Calderara et al. | 439/137 |

FOREIGN PATENT DOCUMENTS 2210513 8/1978 Germany .

*Primary Examiner*—Neil Abrams
*Attorney, Agent, or Firm*—Hoffmann & Baron

[57] ABSTRACT

A child-proof electrical socket assembly is provided. The socket assembly includes a cover plate 1 having openings for receiving the prongs of a plug. A shield plate 4 is slidably mounted in adjoining relation to the cover plate such that the shield plate is slidable between a closed position where it occludes the openings in the cover plate and an open position wherein these openings are exposed. A barrier 8 is provided for engaging the shield plate and preventing it from moving to the open position upon insertion of a pin or other foreign object within one of the openings within the cover plate. The insertion of a plug, however causes the shield plate to slide towards the open position without interference from the barrier means.

13 Claims, 8 Drawing Sheets

ELECTRICAL SOCKET ASSEMBLY INCLUDING SAFETY DEVICE

BACKGROUND OF THE INVENTION

1. Field of the Invention

The present invention relates to an electrical socket assembly, and particularly to a socket assembly having built-in safety means preventing the insertion of a single pin into the contact opening connected to the live wire.

2. Brief Description of the Related Art

Sockets of this type are particularly intended to prevent insertion of conducting single pins into the live wire contact by, for example, playing children, without impeding insertion of a plug connected to an electric appliance into the socket.

The most widely used type of such safety sockets is one in which a rotatable disc having openings corresponding to the contact openings is affixed to the outer side of the cover of the socket, urged by a spring into a position in which the openings in said disc do not correspond to the contact openings, thereby preventing the insertion of anything into the contact openings. In order to insert the plug, it must be inserted into the openings of the disc and afterwards rotated against the force of said spring until the openings in the disc coincide with the contact openings, thereby connecting the appliance to the current source.

This relatively simple arrangement has two drawbacks. First, the cover disc may be also rotated by inserting a single pin into one opening and, after this opening is aligned with a contact opening, the single pin will enter the contact. If this contact is connected to the live wire, an accident may result. The second drawback is that the normal insertion of the plug is impeded. As a first step, the plug must be rotated until the openings in the cover disc are aligned with the contact openings.

There is known another type of safety socket, also intended to prevent insertion of a single pin into the contact openings. In this socket, both contact openings are covered by a sliding plate arranged on the inner side of the cover plate of the socket, slidable on the insertion of the plug in a direction normal to the line connecting the contact openings. The sliding plate is slidable only in the case when both contact pins of the plug are introduced simultaneously. Means are provided for locking the sliding plate in the covering position in case one tries to insert a single pin into one of the contact openings. A socket of this type is known, inter alia, from German Patent No. 22 10 513.

SUMMARY OF THE INVENTION

The present invention relates to a safety socket including shield plate or shutter mounted for sliding movement in a direction normal to the line connecting the live and the neutral contact openings and tiltable out of the plane parallel to a socket cover plate. The shield plate or shutter covers the live and neutral contact openings prior to insertion of a plug, and preferably is urged by a single or a plurality of springs towards the position in which it covers the contact openings. Interacting arresting means, preferably provided on the shield plate and/or a holding plate, locks the shield plate against sliding movement in case the shield plate is tilted out of the plane parallel to the socket plate and the holding plate.

The shield plate covering the contact openings may slide into a position in which said contact openings are exposed only when the plate remains parallel to both the socket cover and the holding plate. The plate is blocked when pivoted away from this position by an attempt to insert either a single pin or two pins which are not inserted simultaneously. By inserting two pins (the two prongs of the plug) in parallel and strictly simultaneously, the sliding plate is constrained to remain in the parallel position and therefore remains freely slidable, enabling the prongs to displace the shield plate and enter the contacts.

The shield plate may be guided for sliding and/or pivotable with a clearance from both the socket cover and the holding plate by various means. For example, it may slide along a rod held in the holding plate while being urged into the covering position by a spiral spring surrounding the rod. The clearance may be established by rods at the middle of the shield plate or by suitable ridges, possibly co-operating with grooves, formed on the shield plate, the holding plate or possibly also on the socket cover. The shield plate may also be guided along both edges thereof and the guide rod dispensed with, the spring being held only in two corresponding recesses in the holding plate and the shield plate.

Adaption of the shield plate for the guided sliding movement may preferably be achieved by the shield plate having a beveled or inclined edge at the end facing the contact openings. The end facing the contact openings need not be slanted along the whole length thereof, but only in its regions facing said contact openings.

Of course, in case there is a third contact for a grounding connection, this remains uncovered all the time and the entire safety arrangement is disposed away from this third opening.

A particular advantage of the claimed invention is that there is only a very small number of component parts.

The invention will be described in more detail with respect to the appended drawings. Owing to the simplicity of the arrangement, many of the drawings are schematic.

DETAILED DESCRIPTION OF THE INVENTION

Figure 1:
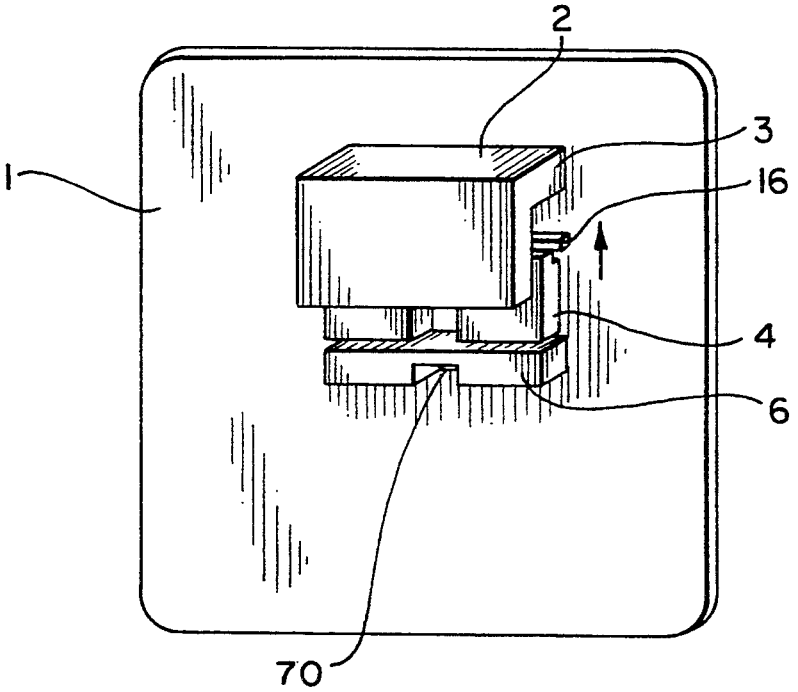
FIG. 1 is an isometric view of a safety assembly mounted on a socket cover.

FIG. 1 is an isometric view towards the back side of the socket cover. Reference number 1 denotes the socket cover, and numeral 2 designates a holding plate having a projection 3 affixed to the socket cover. The holding plate 2 can alternatively be affixed to the cover 1 at a bar 6 affixed to the socket cover. A sliding shield plate 4 covers the live wire and the neutral contacts and is slidable in the direction of the arrow. In sockets where the socket cover is attached to the body of the socket by a screw connection in a central, or possibly off-central post, the sliding shield plate 4 may be of a U-shape, the limbs of the U covering the live wire and the neutral contact openings, the space between the two limbs accommodating the central post.

The bar 6 affixed to the socket cover retains the sliding plate 4; this bar may include a recess 70 for accommodating a grounding contact in case such is present.

The holding plate 2 may be integrally molded with the socket cover 1. Alternatively, the holding plate 2 may be affixed to the socket cover by suitable means, such as adhesives or screw connections.

Bar 6 may also be affixed to the socket cover or be integrally molded with the same. The sliding plate 4 is simply freely inserted at a suitable stage. The sliding plate is urged towards the position covering the contacts by a spring, indicated in FIG. 2 by numeral 7. In the specific embodiment shown in this Figure, the spring 7 is held within recesses in the holding plate 2 and sliding plate 4.

FIGS. *2a* to *2f* illustrate particular embodiments of the locking means. The same numerals are used to designate the same or similar elements.

FIG. *2a* illustrates the step 8 formed in the holding plate. It is clear that in case the sliding plate is tilted out from the parallel position, the higher end thereof engages this step and the plate 4 is prevented from sliding.

For sake of further clarity, FIGS. *3b*and *3c* illustrate the arrest of the sliding plate 4 by step 8, when plate 4 is tilted about a pair of pivot members 30. FIG. *3a* illustrates the position in which sliding of plate 4 is possible i.e., when in the plane parallel to both the socket cover 1 and holding plate 2.

FIG. *2b* illustrates an extension 9 of the holding plate 2. This forms, together with the upper part of the holding plate, a recess 10 accommodating the sliding plate 4 only in case it remains parallel to the upper and lower parts of holding plate 2.

FIG. *2c* illustrates a bar 11, formed on the holding plate 2, co-operating with a step 12 on the sliding plate. When the sliding plate is tilted, bar 11 and step 12 interengage, locking the sliding plate.

FIG. *2d* illustrates a groove 12 formed in the holding plate and a bar 14 on the sliding plate. When the sliding plate is tilted, groove 13 and bar 14 interengage, locking the sliding plate.

Figure 2:
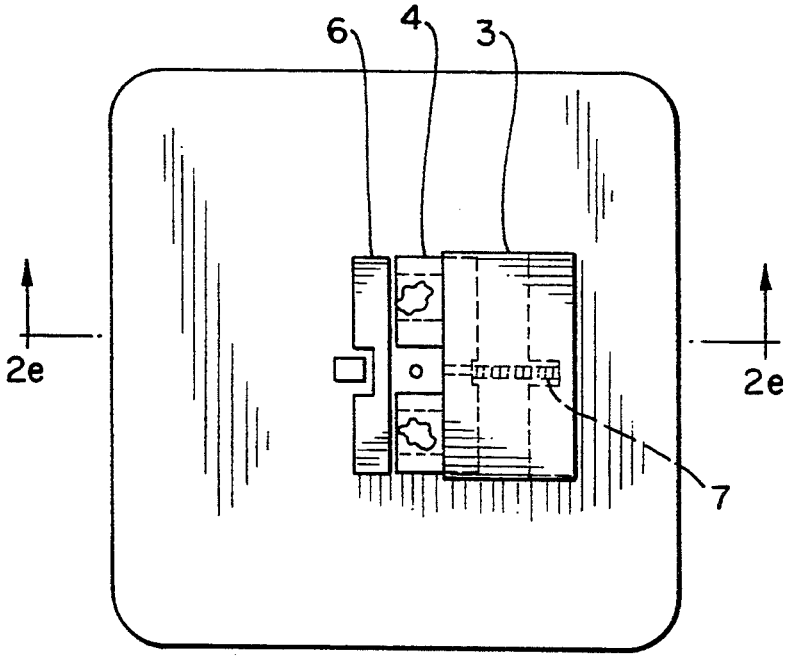
FIG. 2 is a plan view of the arrangement of FIG. 1.
Figure 2A:
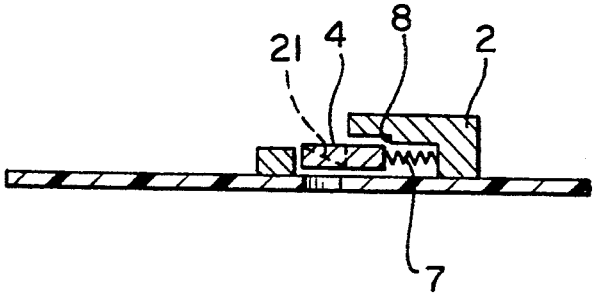
FIGS. 2*a*–2*f* are sectional, schematic illustrations showing alternative embodiments of the inventor.
Figure 2B:
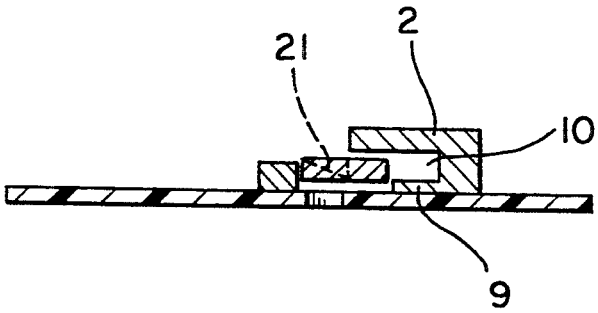
Figure 2C:
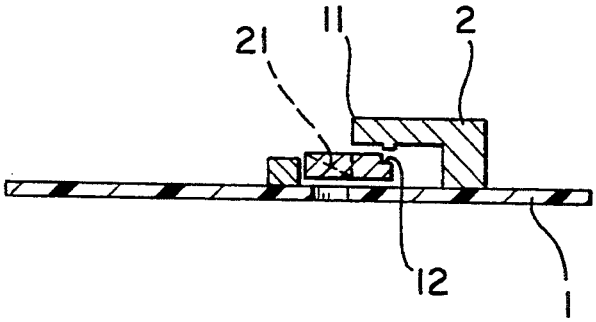
Figure 2D:
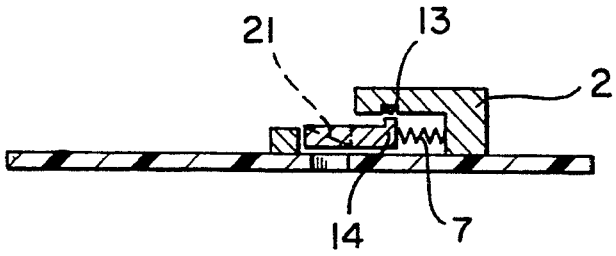
Figure 2E:
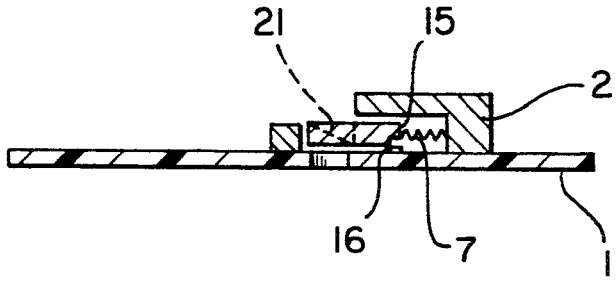
Figure 2F:
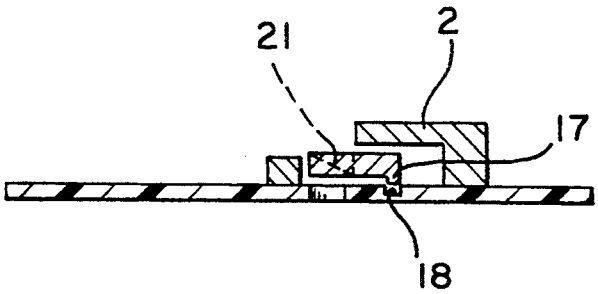
Figure 3A:
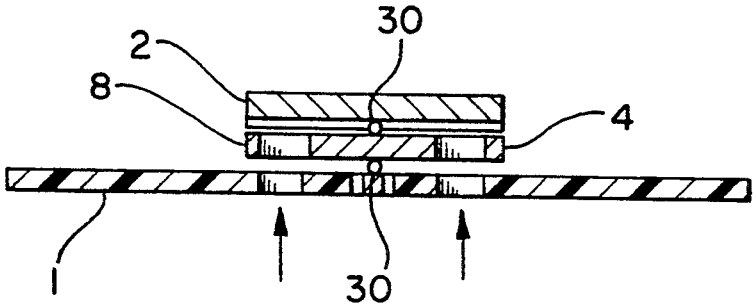
FIGS. 3*a* to 3*c* illustrate the position of the sliding shield plate upon insertion of a plug, a first pin, and a second pin into the socket, respectively.
Figure 3B:
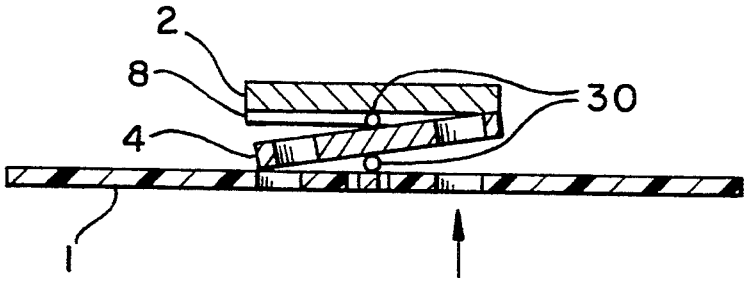
Figure 3C:
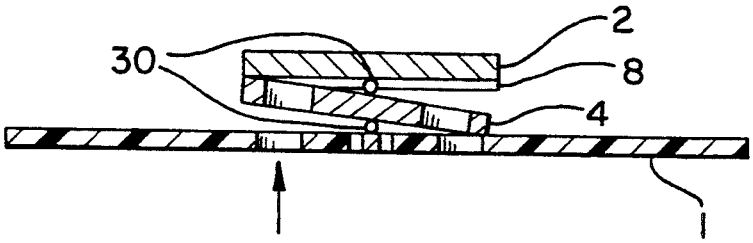

FIG. *2e* is a sectional view taken along line A—A of FIG. 2, and illustrates a step 15 on the sliding plate and a bar 16 on the inner side of the socket cover. When plate 4 is tilted, step 15 engages bar 16, locking the plate 4.

FIG. *2f* illustrates a bar 17 on the sliding plate 4 and a groove 18 in the socket cover. When plate 4 is tilted, bar 17 enters groove 18, locking plate 4.

Figure 4:
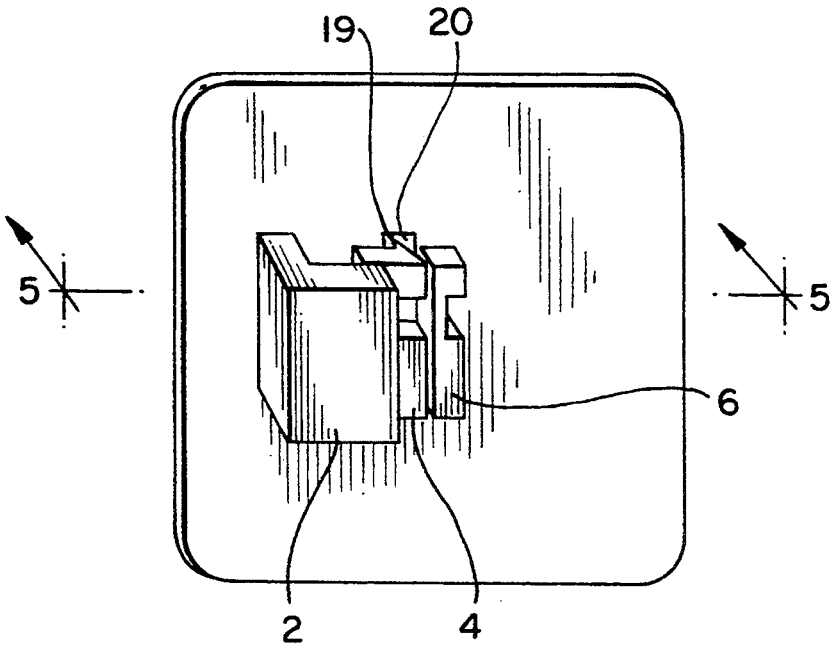
FIG. 4 is an isometric, sectional view of an additional embodiment.
Figure 5:
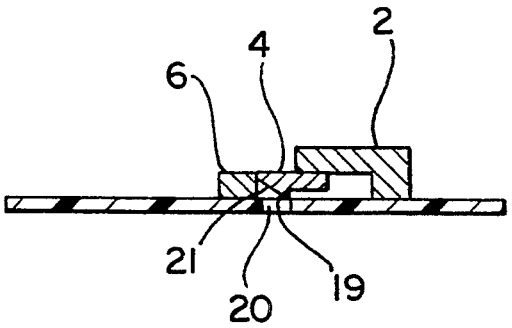
FIG. 5 is a cross-sectional view, along the line B—B of FIG. 4.
Figure 6:
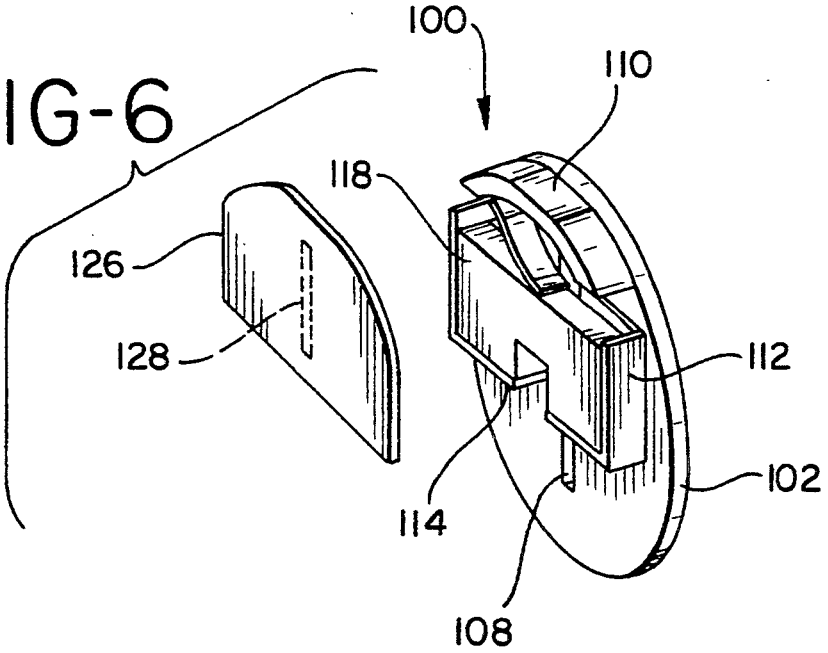
FIG. 6 is an exploded, perspective view of an alternative and preferred embodiment of the invention.

FIG. 5 is a cross-section along the line B—B in FIG. 4, which is an isometric cross-section, and illustrates an embodiment of the invention in which a protrusion 19 on the sliding plate 4 enters the opening in the socket cover 1 for the insertion of a plug, indicated by 20, thereby locking sliding plate 4.

As may be seen in FIGS. *2a* to *2f* and 5, the edge 21 of the sliding plate 4 facing the contact openings is inclined, enabling the sliding of plate 4, when, for example, the two prongs of a plug are inserted into said contact openings.

Figure 7A:
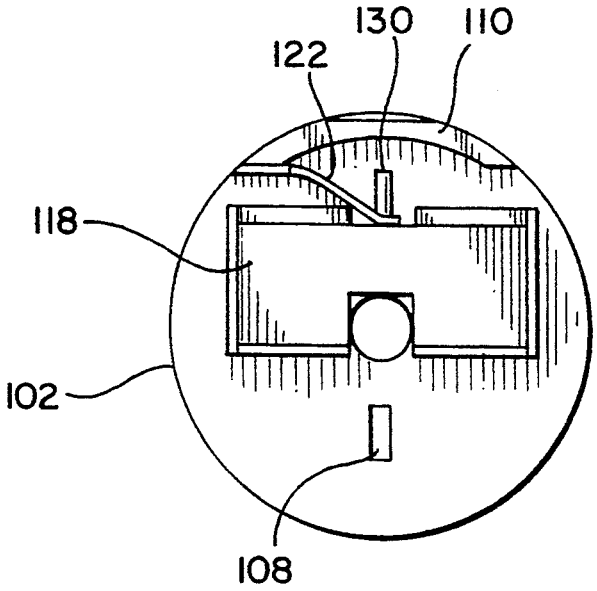
FIG. 7*a* to 7*c* illustrate the shield plate of the embodiment of FIG. 6 in three different positions.
Figure 7B:
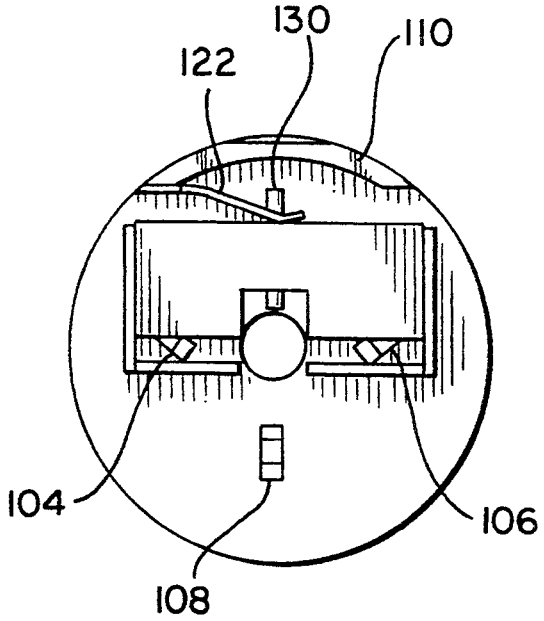
Figure 7C:
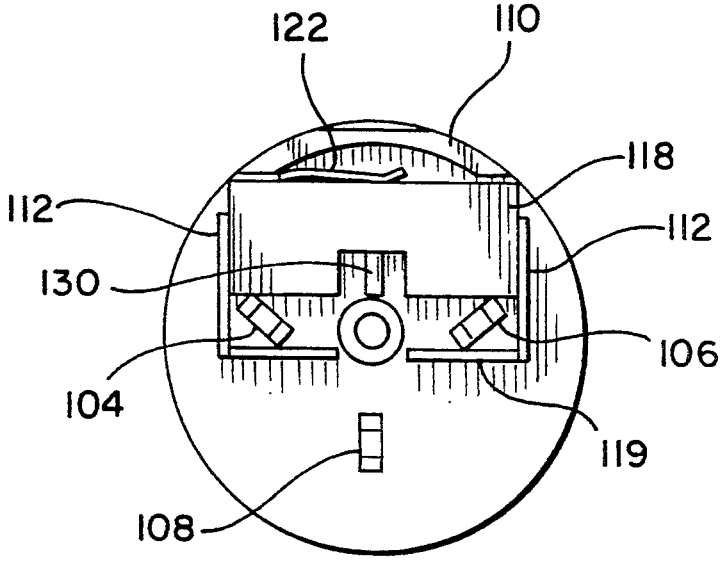
Figure 8:
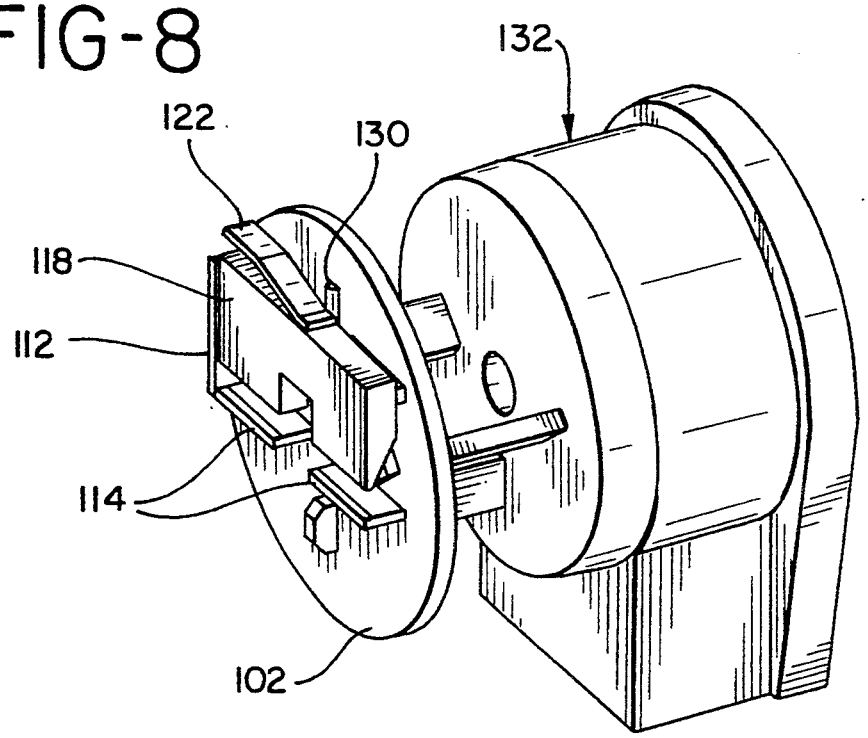
FIG. 8 is a perspective view illustrating the connection of a plug to the socket assembly shown in FIG. 6.
Figure 9:
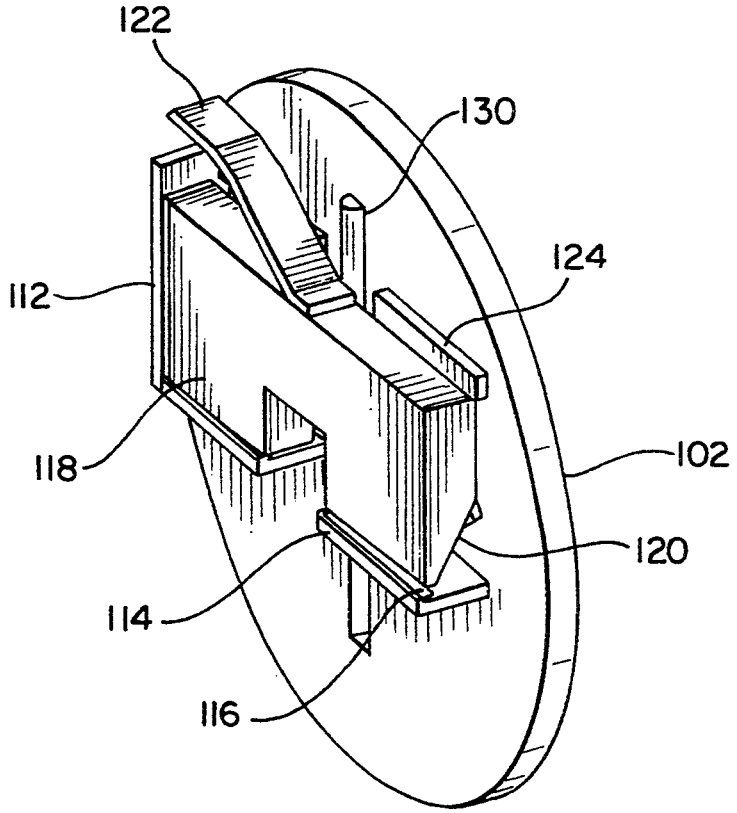
FIG. 9 is a perspective view showing the socket assembly upon insertion of a pin into one of the openings in the cover plate.

FIGS. 6–9 illustrate an alternative, and preferred, embodiment of the invention designed for use with a three-pronged outlet. This socket assembly 100 includes a cover plate 102 having three openings 104, 106, 108. A top wall 110 is secured to or molded integrally with the cover plate. A pair of side walls 112 and bottom walls 114 are secured to the cover plate in a similar manner. Referring to FIG. 9, the bottom walls each include a lip 116 to increase the difficulty of inserting a pin through the socket assembly and into one of the electrical contacts. A shutter plate 118 includes a generally rectangular body having a bevelled lower edge 120. This edge 120 is in opposing relation to two of the openings 104, 106 in the cover plate when the socket assembly is not in use, i.e., when a plug is not inserted therein.

A leaf spring 122 is mounted to the top wall 110 and resiliently urges the shutter plate 118 towards the bottom walls 114. The ability of the shutter plate to slide is restricted by the bottom walls 114 and one of the top wall 110 and an elongate bar 124 mounted to the cover plate 102. The orientation of the shutter plate 118 with respect to the cover plate 102 determines whether the bar 124 or the top wall 110 limits the maximum upward movement of the shutter plate. The distance between the top surface of the shutter plate and the bottom surface of the bar 124 is preferably less than the height of the lip 116 when the shutter plate engages the bottom walls 114.

A holding plate 126 having a recess is mounted to the cover plate 102. The holding plate is sufficiently narrow that it does not interfere with the prongs of a plug which may extend through the openings 104, 106, 108. An elongate protrusion 128 on the front side of the holding plate and an opposing, parallel protrusion 130 extending from the cover plate 102 allow the shutter plate 118 to pivot about an axis parallel to the protrusions. Spring means (not shown) may be provided for urging the shield plate about this axis, or maintaining the shutter parallel to the cover plate.

FIGS. *7a–7c* and FIG. 8 show the insertion of a three-pronged plug 132 into the socket assembly. As substantially equal pressure is exerted by two of the prongs against the bevelled edge 120 of the shutter plate 118, the shutter plate is displaced as shown in FIGS. 7B and 7C. In contrast, if a pin is inserted within one of the openings 104, 106, the shutter plate will pivot about an axis running between the two openings and engage the bar 124 before it can be displace significantly upwardly. As discussed above, the lip 116 extending from each bottom wall prevents a pin inserted between the bottom surface of the shutter plate and the top surface of the bottom wall from engaging an electrical contact.

What is claimed is:

1. An electrical socket assembly comprising:

a cover plate having first and second openings for receiving first and second prongs of a plug;

a shutter plate means for slidably mounting said shutter plate in adjoining relation to said cover plate such that said shutter plate is slidable in a direction which is perpendicular to an imaginary line connecting said first and second openings and between a closed position where it occludes said first and second openings and an open position wherein said first and second openings are exposed;

means for allowing said shutter plate to pivot about an axis extending substantially perpendicular to said imaginary line and parallel to said cover plate, between a first rotational position and a second rotational position; and barrier means including a projection extending from said cover plate for engaging an outer edge of said shutter plate, thereby restricting the movement of said shutter plate from said closed position to said open position, said barrier means preventing said shutter plate from sliding from said closed position to said open position when said shutter plate is in said second rotational position but allowing said shutter plate to slide from said closed position to said open position when said shutter plate is in said first rotational position.

2. An assembly as described in claim 1 wherein said shutter plate is substantially parallel to said cover plate when in said first rotational position.

3. An assembly as described in claim 2 including a holding plate secured to said cover plate, said shutter plate being positioned between said holding plate and said cover plate.

4. An assembly as described in claim 3 including means for resiliently urging said shutter plate towards said closed position.

5. An assembly as described in claim 4 including a bottom wall connected to said cover plate, said shutter plate engaging said bottom wall when in said closed position.

6. An assembly as described in claim 5 wherein said bottom wall includes a lip for preventing an object inserted between said bottom wall and said shutter plate from extending beyond said lip.

7. An assembly as described in claim 4 wherein said shutter plate includes an inclined surface in opposing relation to said first and second openings such that said shutter plate is urged towards said open position upon insertion of the prongs of a plug through said first and second openings.

8. An assembly as described in claim 7 including a top wall secured to said cover plate, and a spring mounted between said top wall and said shutter plate for resiliently urging said shutter plate towards said closed position.

9. An assembly as described in claim 1 including means for resiliently urging said cover plate towards said closed position.

10. An electrical socket assembly comprising a cover plate having first and second openings for receiving first and second prongs of a plug and a projection extending inwardly from an inner surface of said cover plate;

a shutter plate slidably mounted in adjoining relation to said cover plate such that said shutter plate is slidable in a direction which is perpendicular to an imaginary line connecting said first and second openings, said shutter plate being slidable between a closed position wherein it occludes said first and second openings and an open position wherein said first and second openings are exposed;

said shutter plate being of integral construction and including an outer, peripheral edge, said peripheral edge including a top surface engageable with said projection for restricting movement of said shutter plate from said closed position to said open position, and a bottom surface including first and second adjoining bevelled portions in opposing relation to said first and second openings, respectively, when said shutter plate is in said closed position, a spring urging said shutter plate towards said closed position, and said shutter plate being pivotably mounted to said cover plate such that said shutter plate is pivotable about a pivot axis extending perpendicular to an imaginary line connecting said first and second openings and parallel to said cover plate, said shutter plate being substantially symmetrical with respect to said pivot axis.

11. An assembly as described in claim 10 including a wall secured to said cover plate and adjoining said bevelled portion of said shutter plate when said shutter plate is in said closed position.

12. An assembly as described in claim 10 wherein said shutter plate has a generally U-shaped configuration.

13. An assembly as described in claim 12 including a wall extending from said cover plate and adjoining the bevelled portion of said shutter plate.

* * * * *